US005551939A

United States Patent [19]

Deckers

[11] Patent Number: 5,551,939

[45] Date of Patent: Sep. 3, 1996

[54] ZIGZAG FOLDING DEVICE

[75] Inventor: Rudolf J. H. R. Deckers, Eindhoven, Netherlands

[73] Assignee: Oce-Nederland, B.V., Venlo, Netherlands

[21] Appl. No.: 288,266

[22] Filed: Aug. 11, 1994

[30] Foreign Application Priority Data

Aug. 27, 1993 [NL] Netherlands ..... 9301483

[51] Int. Cl.[6] ..... B65H 45/16

[52] U.S. Cl. ..... 493/442; 493/419

[58] Field of Search ..... 493/416, 419, 493/421, 442, 441, 405

[56] References Cited

U.S. PATENT DOCUMENTS

| | | | |
|---|---|---|---|
| 3,747,917 | 7/1973 | Roda | 493/419 |
| 4,425,696 | 6/1995 | Hara | 493/419 |
| 4,484,905 | 11/1984 | Ashburner | 493/419 |
| 5,344,379 | 9/1994 | Garrone | 493/419 |

FOREIGN PATENT DOCUMENTS

| | | | |
|---|---|---|---|
| 0156326 | 10/1985 | European Pat. Off. . | |
| 2101582 | 3/1972 | France . | |
| 2227582 | 1/1974 | Germany | 493/419 |
| 8709968 | 10/1987 | Germany . | |
| 1349558 | 4/1974 | United Kingdom . | |

*Primary Examiner*—Jack W. Lavinder
*Attorney, Agent, or Firm*—Birch, Stewart, Kolasch & Birch, LLP

[57] ABSTRACT

A folding device for the zigzag folding of a sheet, including two pairs of folding rollers which form two folding nips and which rollers are drivable alternately in opposite directions of rotation, and a pair of feed rollers which alternately feed a sheet for folding to the folding nips, the speed of conveyance of the folding rollers being initially 120% of the speed of conveyance of the feed rollers and, after passage of the leading sheet edge through the first of the two folding nips, it is 110% of the speed of conveyance, wherein after each reversal of direction of rotation of the folding rollers, the speed of conveyance of the folding rollers is initially 110% of the speed of conveyance of the pair of feed rollers and, shortly after passage of a fold made in the associated folding nip, it is 100% thereof. For realizing a desired folding length the set process time between the start of a folding cycle and the change of the direction of drive of the folding rollers is automatically adjusted in dependency of this folding length (V) and the total sheet length (L).

7 Claims, 6 Drawing Sheets

ZIGZAG FOLDING DEVICE

BACKGROUND OF THE INVENTION

1. Field of the Invention

The invention relates to a folding device for folding sheet goods, and more specifically to the zigzag folding of a sheet.

2. Discussion of Related Art

A folding device of this kind is known from European patent EP-B 0 156 326. In the folding device described therein, the speed of conveyance of the folding rollers during folding is always greater than the speed of conveyance of the feed means. Only when the leading edge of a sheet for folding arrives in a folding nip for the first time is the speed of conveyance of the folding rollers reduced for a short time to the speed of conveyance of the feed means. The faster-conveying folding rollers serve to tighten a sheet, which has to be folded in the bends that the sheet must traverse between the feed means and the folding nips, to ensure that the sheet is folded exactly at predetermined places.

One disadvantage of this known folding device is that slip can easily occur between superposed parts of the sheet fed through a folding nip, because the coefficient of friction between sheet surfaces is generally lower than that between a nip-forming surface and a sheet surface. One consequence of such slip is that sheet parts interconnected by a fold shift relatively to one another and, on the subsequent return, pass through the folding nip in the shifted state with the formation of an unwanted second fold in addition to a previous formed fold.

SUMMARY OF THE INVENTION

Therefore, it is an object of the present invention to provide a zigzag folding device which will overcome the above-noted disadvantages.

It is a further object of the present invention to provide a zigzag folding device which eliminates slippage and ultimate unwanted folds in copying sheets.

The foregoing objects and others are accomplished in accordance with the present invention, generally speaking, by providing a folding device comprising folding rollers which form two parallel folding nips, each drivable alternately in opposite directions of rotation. The respective folding nips are situated at some distance from one another in a folding path, and a feed means for feeding a sheet to be folded in the folding path between the folding nips. Deflecting means are provided for alternately deflecting a supplied sheet part to the folding nips, the speed of conveyance of the folding rollers being greater than or equal to the speed of conveyance of the feed means. According to the invention, control means are provided which, shortly after a sheet has been folded in a folding nip, change the folding rollers over from a first speed of conveyance greater than the speed of conveyance of the feed means, to a second speed of conveyance equal to the speed of conveyance of the feed means and maintain the second speed of conveyance until the next change of direction of the drive of the folding rollers. Consequently, no incorrect folds are formed in the sense of double folds on a fold line, due to the absence of tensile forces on the sheet after folding, while after a fold has been made the sheet is pulled taut to avoid creasing in the sheet and since the sheet is taut in the bend on bending of the sheet prior to the formation of a following fold on the bend line, the sheet is prevented from bending the wrong way on the bend line.

According to another aspect of the invention, the control means sets the folding rollers at the start of the folding cycle to a third speed of conveyance greater than the first speed of conveyance and changes over this set speed of conveyance, shortly after the leading edge has for the first time been taken through a folding nip, to a fourth speed of conveyance less than the third, but greater than the second speed of conveyance, and maintains this fourth speed of conveyance until the next change of direction of drive of the folding rollers. Consequently, prior to making the first fold the sheet for folding also bears in contact tautly in the bend, without strong tensile forces being exerted for long periods on the sheet and possibly interfering with the folding process.

In one advantageous embodiment of a folding device according to the present invention, the folding nips are formed by rollers coupled directly to a drive. By driving the nip-forming folding rollers directly, both folding rollers apply the same conveying force to the folded sheet between them at the first speed of conveyance of the folding rollers in order to also minimize the risk of slip on superposed sheet parts at the first speed of conveyance as well.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DISCUSSION OF THE INVENTION

Figure 1:
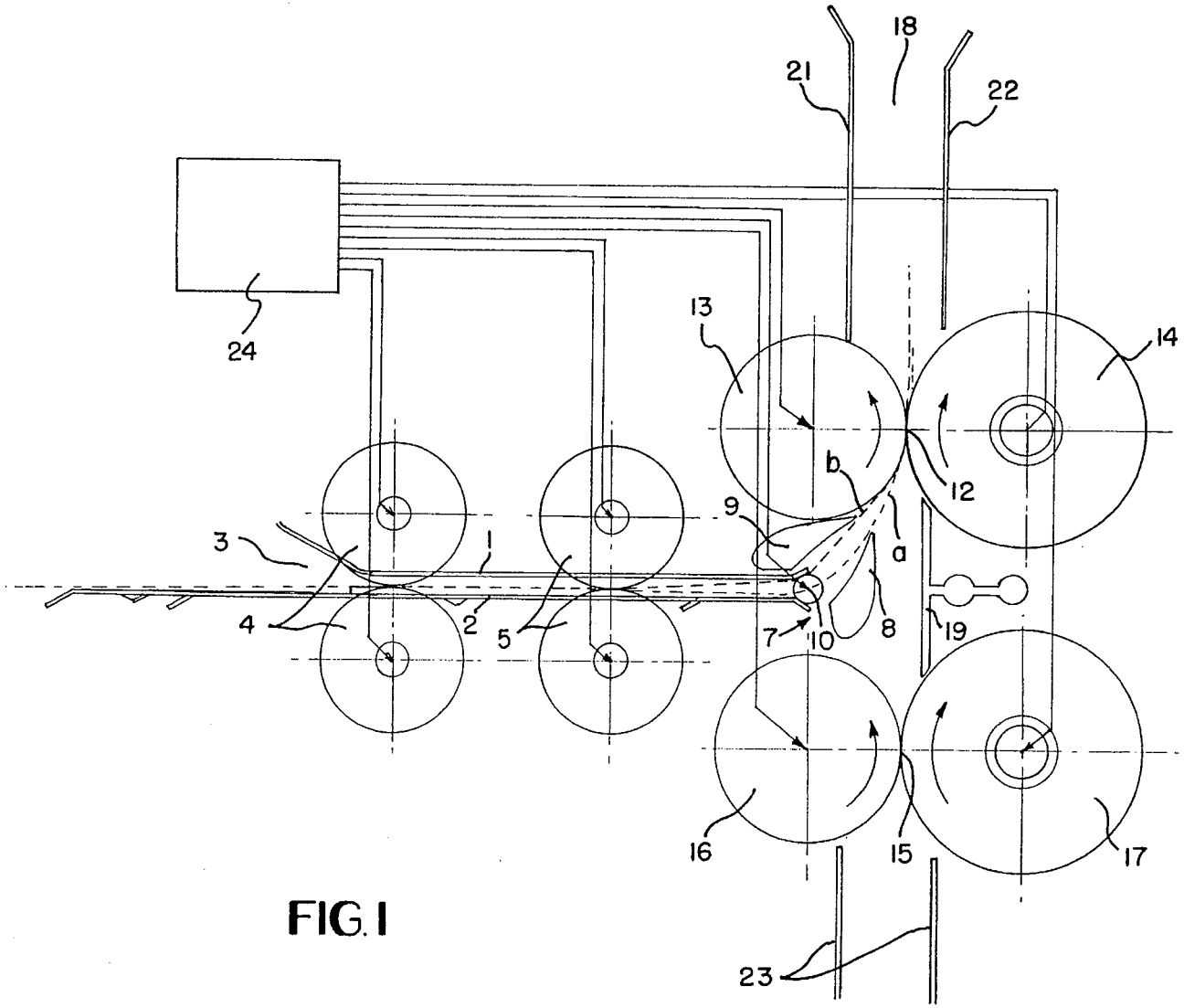
FIG. 1 is a cross-section of a folding device according to the invention shown in a starting position for performing a folding cycle.
Figure 2:
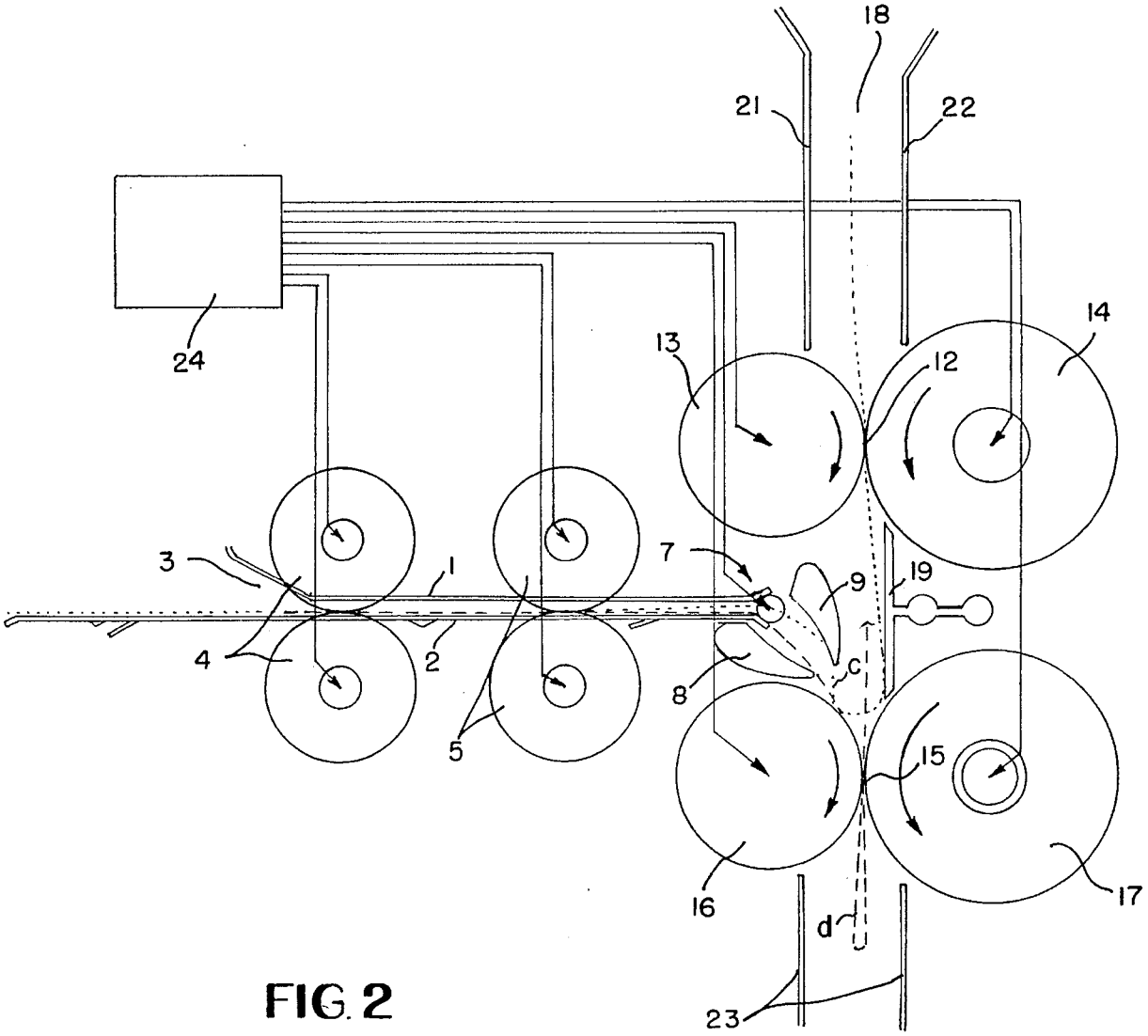
FIG. 2 shows the folding device of FIG. 1 in a position in which a first fold is made.
Figure 3:
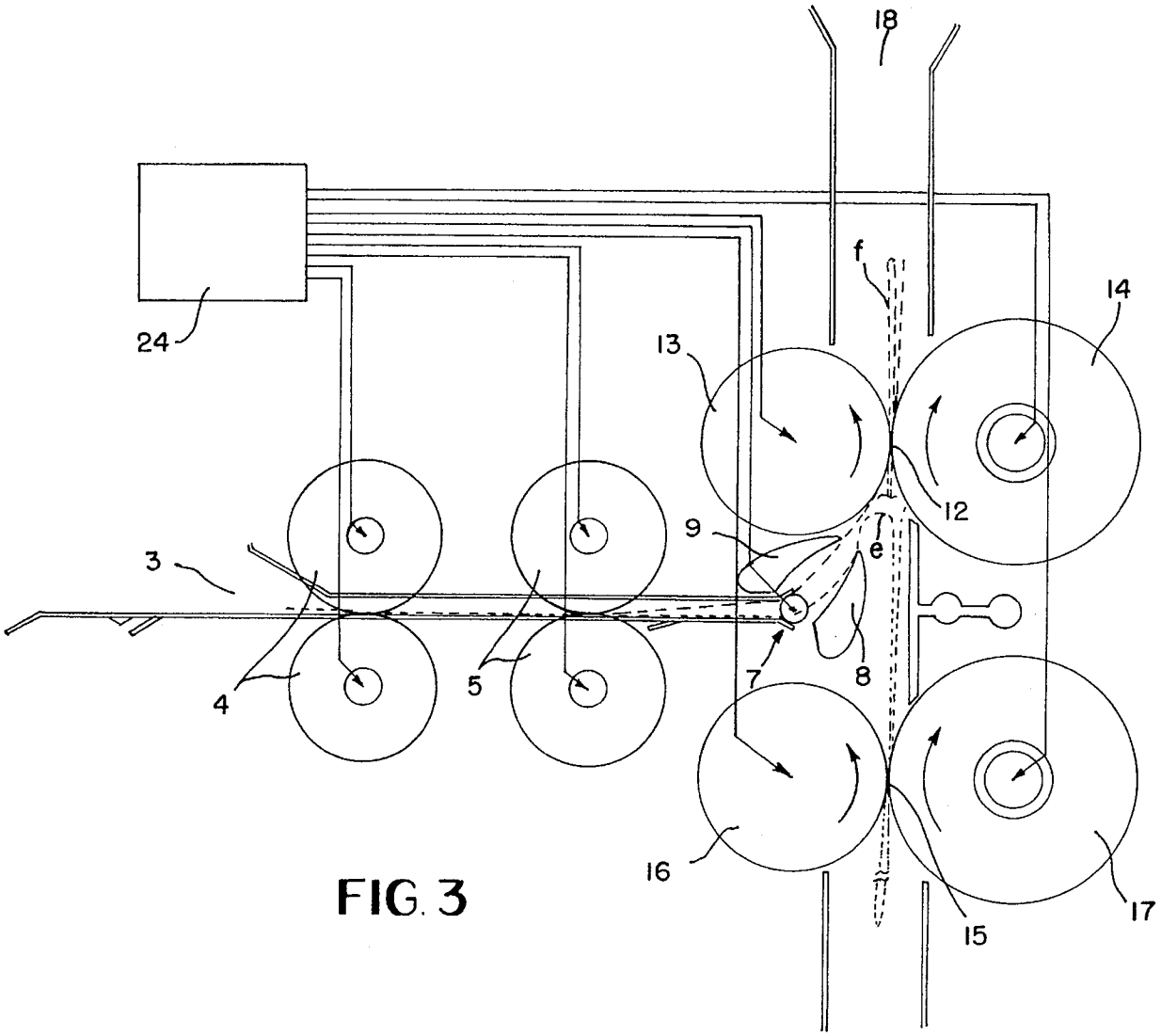
FIG. 3 shows the folding device of FIG. 1 in a position in which a second fold is made.

FIGS. 1 to 3 show a folding device for the transverse zigzag folding of a sheet already zigzag folded in the longitudinal direction, the device embodying the principles of the present invention. A sheet folded in the longitudinal direction is fed via a feed path 3 formed by guide plates 1 and 2, to two feed roller pairs 4 and 5 rotating at a constant speed. For slip-free transport the bottom feed rollers of the roller pairs are provided with a tungsten carbide coating while the top feed rollers cooperating therewith are provided with a rubber coating. The feed rollers press flat on the fold lines of the fed sheet already zigzag folded in the longitudinal direction, so that on further transport through bends in the folding device it is ensured that there is a minimum difference in the radii of the bends traversed by superposed sheet parts. The feed rollers feed the sheet between guide plates 1 and 2 to a funnel-shaped folding flap 7 which comprises two guide plates 8 and 9 whose sides are fixed to pivot ends 10 rotatable in frame plates (not shown) of the folding device about an axis of rotation situated in the plane of the feed path 3. In this way the guide plates 8 and 9 of the folding flap 7 can occupy two end positions shown respectively in FIGS. 1 and 2. In the one end position shown in FIG. 1, the guide plates are directed towards the nip 12 between the folding rollers 13 and 14, while in the other end position shown in FIG. 2 they are directed towards the nip 15 between folding rollers 16 and 17. The folding nips 12 and 15 are situated in a folding path 18 extending in a direction perpendicular to the feed path 3. A guard plate 19 is disposed between the folding rollers 14 and 17 and bounds the folding path 18 at the side remote from the feed path 3 between the pairs of folding rollers 13, 14 and 16, 17.

At the start of a folding cycle, the folding flap 7 is in a position in which the guide plates 8 and 9 are directed towards the folding rollers 13 and 14, as shown in FIG. 1. The folding rollers then rotate in a direction shown by the arrows in FIG. 1. In this situation the leading edge of the sheet is fed into the nip 12, the folding rollers 13, 14 gripping this edge and feeding it into the folding path 18 formed by guide plates 21 and 22. To make a fold in the sheet, a control device 24 reverses the direction of rotation of the folding rollers 13, 14 and 16, 17 after expiration of a predetermined period in which the feed rollers 4, 5 feed the sheet, and the pivot ends 10 of the folding flap are pivoted such that the guide plates 8 and 9 occupy their other end position and are directed towards the folding nip 15 between the folding rollers 16 and 17. In this situation shown in FIG. 2, a loop rapidly increasing in size forms in the sheet due to the continuous supply of sheet material by the feed rollers 4 and 5 and by the return of the leading part of the sheet by the folding rollers 13, 14 to the space enclosed by the folding rollers 13, 14 and 16, 17. When this loop reaches a specific size, it reaches the nip 15 between the folding rollers 16, 17 and is gripped by the latter and, as a result of the pressure exerted in these conditions by the folding rollers, the sheet is folded and fed between guide plates 23 until the control device 24 again reverses the direction of rotation of the folding rollers after expiration of a predetermined period in which the folding rollers 13, 14 and 16, 17 rotate in the direction indicated by the arrows in FIG. 2, and the guide plates 8 and 9 of the folding flap 7 are moved to their other end position. In this situation shown in FIG. 3, a loop is again formed in the sheet material and reaches the space between the folding rollers 13, 14 and the sheet is thus again folded. The zigzag folded sheet is then fed out of the folding device by the folding rollers.

After this description of the general action of the folding device shown in FIGS. 1 to 3, the formation of the loop in the sheet and the further movement cycle during folding will be explained in greater detail with reference to FIG. 4, which shows the curve of the speed of conveyance of the folding rollers 13, 14 and 16, 17 according to the invention during the folding process, compared to the distance over which the feed rollers 4 and 5 rotating at constant speed convey a sheet for folding. A sheet for folding is fed by the feed rollers 4 and 5 at a constant speed of 20 m per min. At the start of a folding cycle the folding rollers are brought to a speed of 24 m per min. The change of speed of the folding rollers, with a constant acceleration/deceleration, is so selected that for a change of speed from zero to 20 m per min the conveying distance of the rollers is 0.0125 m.

The sheet for folding is first fed by the feed rollers 4 and 5 to the nip 12 between folding rollers 13, 14, the sheet being pressed by the feed rollers 4, 5 into the largest possible bend indicated by a in FIG. 1, in which bend the outside of the sheet is pressed against guide plate 8.

After the sheet has been gripped by the folding rollers 13, 14 rotating at a speed of 24 m per min (=120% of the speed of conveyance of the feed rollers), the front part of the sheet is conveyed by the folding rollers 13, 14 at a speed of 24 m per min while the rear part is conveyed by the feed rollers 4, 5 at a speed of 20 m per min. In these conditions, the sheet is rapidly drawn taut against the guide plate 9 and folding roller 13 in the bend, as denoted by b in FIG. 1.

After the tightening operation, in which the sheet is fed past the folding nip 12 to an extent such that it must be conveyed another 140 mm before the speed of conveyance is reversed to make a first fold, the speed of conveyance of the folding rollers is reduced to 22 m per min, at which speed the sheet is fed on in the taut state and without any appreciable slip until the time at which, to produce the first fold, the control device 24 reverses the direction of rotation of the folding rollers and the folding flap 7 starts its movement into the other end position. At the start of this movement, the guide plate 9 and folding roller 13 press against the sheet. This prevents the sheet from bending in the direction of guide plate 9 as a result of the bending forces exerted on the sheet by the feed rollers 4, 5 and folding rollers 13, 14. The folding flap 7 also engages lightly by its guide plate 9 in the loop forming and thus determines the straightness of the fold thereafter gradually formed in the loop. The increasing loop in the sheet reaches the folding nip 15 after the supply of 70 mm of sheet material by the feed rollers 4, 5, given a distance of 90 mm between the folding nips 12 and 15. On the supply of the first 25 mm the folding rollers 13, 14 decelerate over a distance of 12.5 mm with the formation of a loop of 12.5 mm, and on the supply of the next 25 mm the folding rollers 13, 14 accelerate over a distance of 12.5 mm with enlargement of the loop to 50 mm while on the supply of the last 20 mm the folding rollers move at a constant speed, the loop being enlarged to 90 mm. In the position shown by c in FIG. 2, the sheet is gripped by the folding rollers 16, 17 now rotating at 22 m per min (=110% of the speed of conveyance of the feed rollers). As a result of this higher speed of conveyance than the feed speed, the sheet folded in the folding nip 15 is pulled taut against the guide plate 8 while the fold passes the folding nip 15, so that shortly after the first fold the sheet reaches the position shown by d, in which the sheet bears with the minimum possible bend against the guide plate 8. After being pulled taut, which is completed after expiration of a period in which the folding rollers 16, 17 have taken the fold 60 mm past the folding nip 15, the speed of conveyance of the folding rollers is brought to and kept at the same speed of conveyance as the feed rollers 4, 5 for the rest of the period during which the folded sheet moves in the direction of conveyance shown in FIG. 2. This prevents the conveying force exerted on the folded sheet by the folding roller 17 from exerting a tensile force on the folded sheet, which might shift the loose part of the sheet released from the folding rollers 13, 14, relative to the other part of the sheet still retained by feed rollers 4, 5, on which folding roller 16 exerts a conveying force. Since the sheet is pulled taut by the folding rollers 16, 17 directly after folding, this prevents any creasing of the sheet, such as would cause flattened creases in the folding nip. To apply a second fold in the folding nip 12 the same speed profile is traversed as in applying the first fold, as shown in FIG. 3, in which the sheet comes from position e to position f. Thus, when the second fold is made, the same quality is achieved as in making the first fold.

Figure 4:
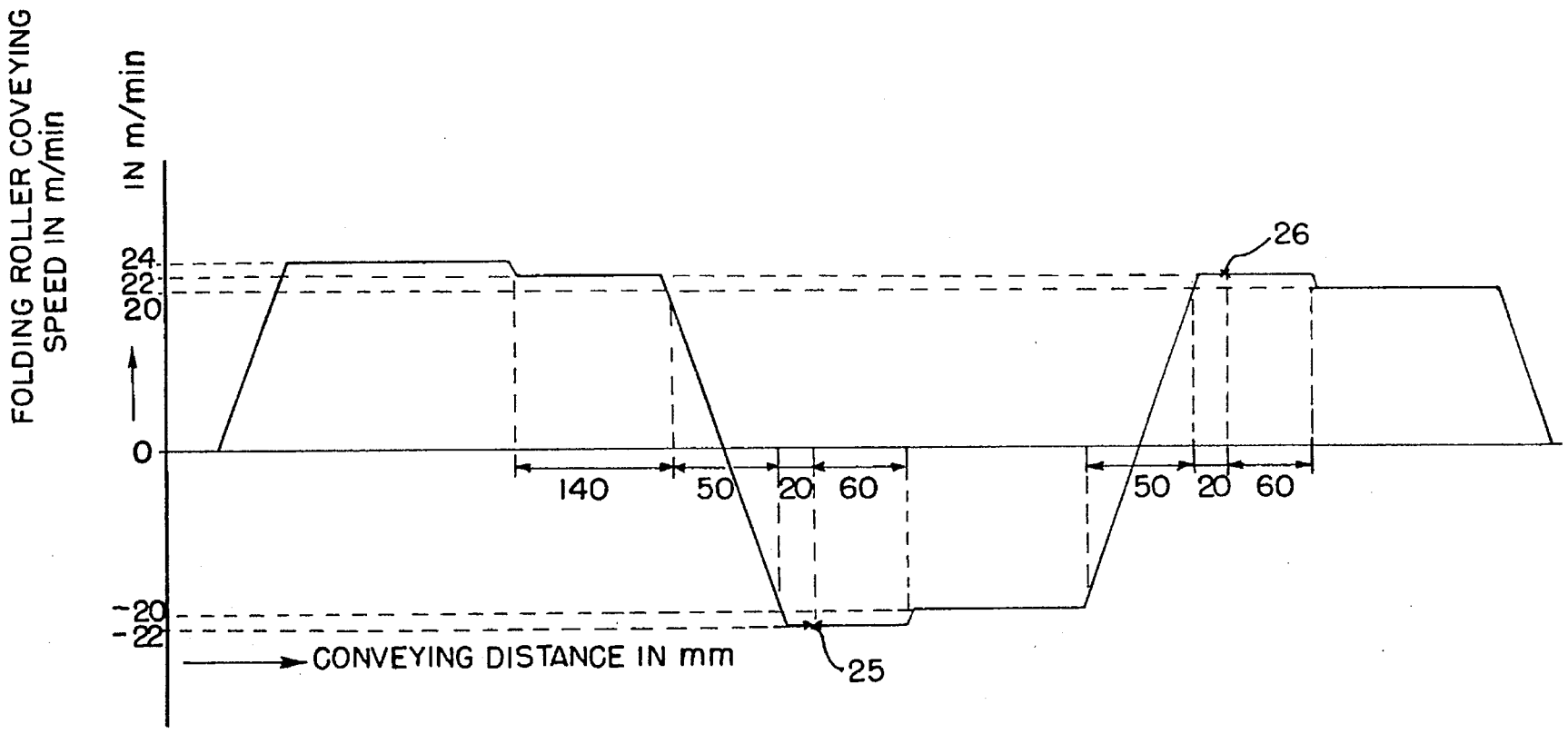
FIG. 4 is a graph showing the speed of conveyance of the folding rollers during a folding cycle.

FIG. 4 is a graph showing the speed of conveyance of the folding rollers, references 25 and 26 indicating the folding locations. The speed of conveyance of the folding rollers is reduced to the feed speed on a supply of a 60 mm sheet length after the folding. The entry speed of the leading part of a sheet for folding into the folding rollers 13, 14 is approximately 10% greater than the entry speed of a fold into the folding rollers 16, 17, as shown in FIG. 4, i.e. 24 m/min as against 22 m/min. This compensates for the larger loop which the loose leading part of the sheet forms before the folding rollers 13, 14 in comparison with a loop which is formed in the sheet prior to the making of a fold. The transit speed of the leading part of the sheet through the folding rollers 13, 14 can also remain at a higher value than the feed speed, in order to hold the part taut, since the sheet has not yet been transversely folded and hence no slip can occur between transversely folded parts.

Figure 5:
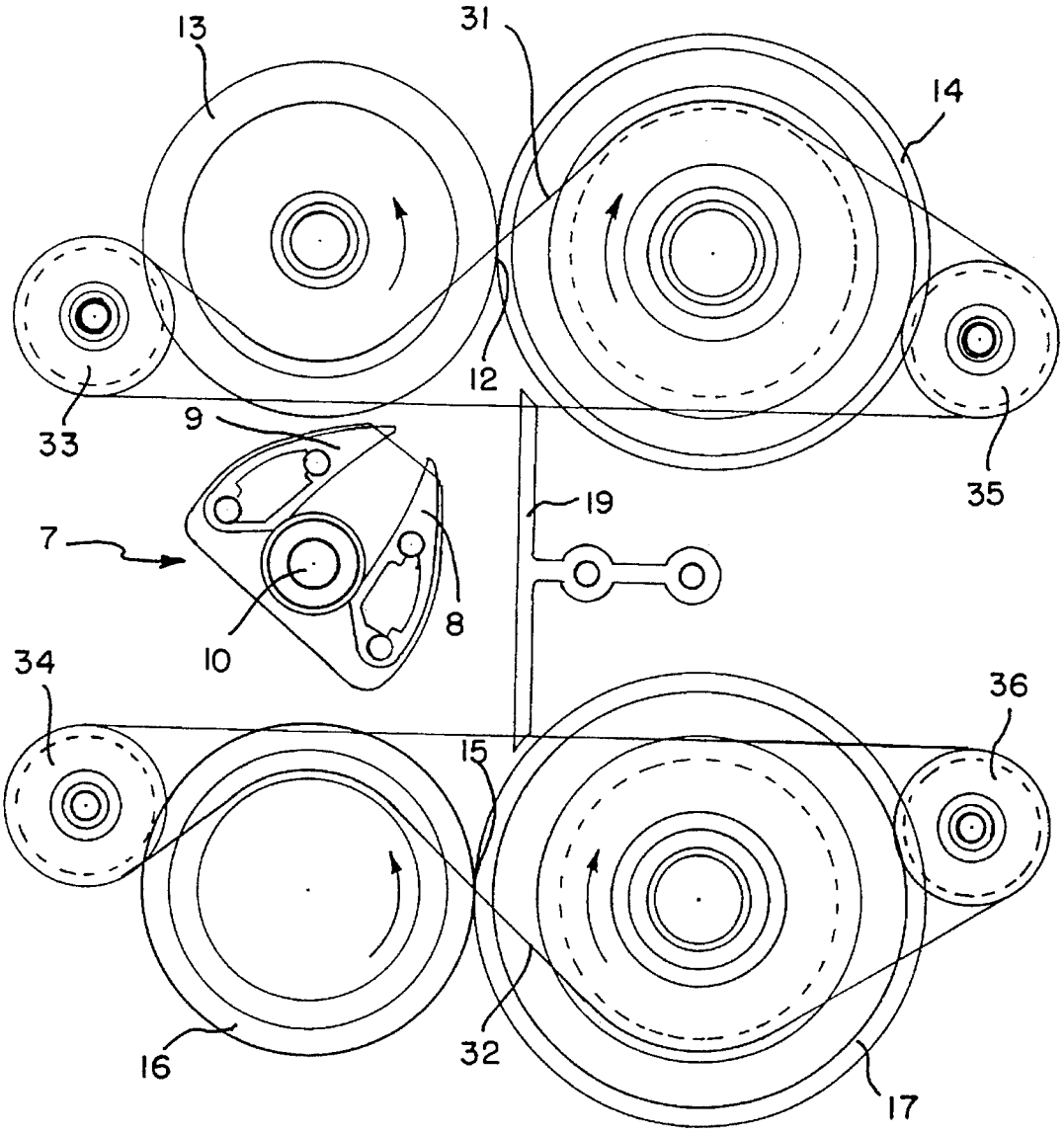
FIG. 5 is a detail of the drive for the folding rollers.

In the folding roller drive, a guide roller is fixed at the end of each folding roller as shown in FIG. 5. Endless drive belts, 31 and 32 respectively, are trained in a meandering fashion around the guide rollers 27, 28 respectively of folding rollers 13 and 14, and around the guide rollers 29 and 30 respectively of folding rollers 16 and 17. The belts are also trained around a drive roller 33 and 34 respectively and a guide roller 35 and 36 respectively, as shown in FIG. 5. When the drive roller 33 is driven in the direction indicated, the folding rollers 13 and 14 rotate in opposite directions of rotation to give slip-free transport to the folding nip 12. The same applies to the drive roller 34 and folding rollers 16, 17 for slip-free conveyance in the folding nip 15. The drive belts 31 and 32 respectively are to some extent elastic in order that the folding rollers may be moved away from one another at the folding nip to allow the passage of a folded sheet while maintaining the drive of the folding rollers which form a folding nip. This prevents a folding roller from being braked when passing a folded sheet through the folding nip (such as may occur with a non-driven folding roller which presses against a driven folding roller), such braking possibly causing stagnation of and slip between superposed sheet parts. If the sheet for folding is thick and hence stiff in the direction of conveyance, the loop formed has a large radius when it meets the folding rollers and presses the latter apart before a fold can be formed in the folding nip. Driving both folding rollers ensures in that case that the loop can nevertheless be pulled into the folding nip. A non-driven folding roller would in that case brake and hence hold the loop back on the non-driven side.

Figure 6:
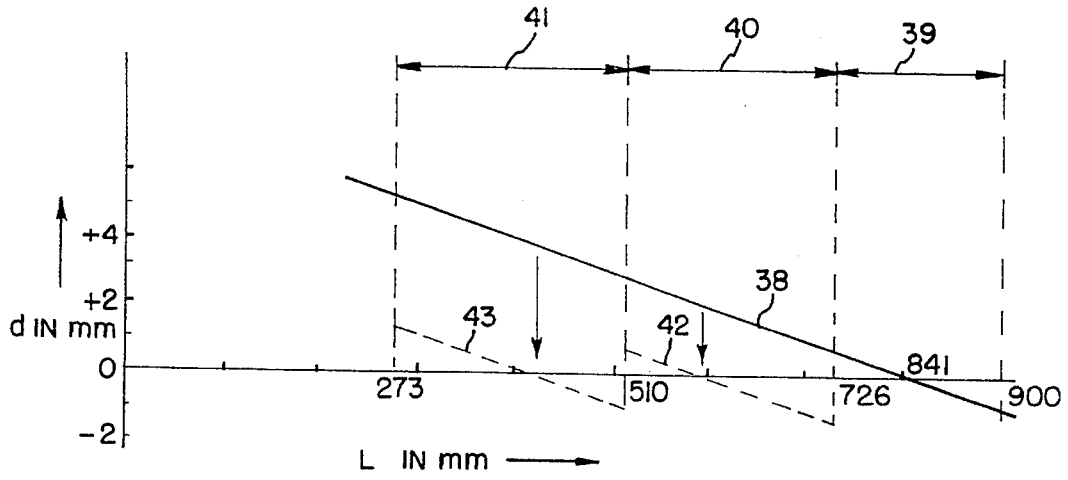
FIG. 6 is a graph showing the relationship between length of a sheet and position-deviation of the first fold which has to be corrected.

To guarantee slip-free transport in the folding nip 12 and the folding nip 15 respectively, the folding nip pressure has to be sufficiently high. To further prevent the sheet from tearing when a speed difference is present between the folding rollers 13, 14 and 16, 17, respectively and the feed rollers 4, 5 and a sheet pulled taut therebetween, the nip pressure between the feed roller is so much lower than the folding nip pressure that the sheet can slip with respect to feed rollers 4, 5 driven at a constant speed. With slip in the feeding nip during transport of the leading sheet edge from the feeding nip to the folding nip and forming of a transverse fold after expiration of a predetermined fixed period in which the feed rollers 4, 5 driven at constant speed feed the sheet, the first transverse fold comes about at a deviant place. The greater this slip is, the later the leading sheet edge arrives at the folding nip, as a result which the first transverse fold will be folded closer to the leading sheet edge, thus coming about a shorter folding length. A sheet already zigzag folded in the longitudinal direction and fed in the feed path 3 that, seen in the feeding direction, is long and then usually also forms a thicker zigzag folded package, experiences more resistance in the feed path 3 than a shorter sheet and thus shows more slip. The relationship between the length of sheet L and the deviation d caused is linear, as shown in FIG. 6 by line 38. A simple correction mechanism for this deviation exists therein to fix the point of time of folding, which point of time is derived from the duration of driving of the feed rollers, for a defined long sheet in the midst of a length-zone 39 (for example a sheet of a length of 841 mm) in such a way that the deviation becomes 0 and to adjust the point of time of folding for the adjacent length-zones 40 and 41 beneath zone 39 in such a way that in the midst of the zones 40 and 41 the deviation becomes 0, as shown in FIG. 6 with interruptions in line-segments 42 and 43. By distinguishing of length-zones 39–41 in a much greater number of line-segments comes about more line-segments than the two line-segments 42 and 43, thus these line-segments all nearly coincide with the X-axis.

Figure 7:
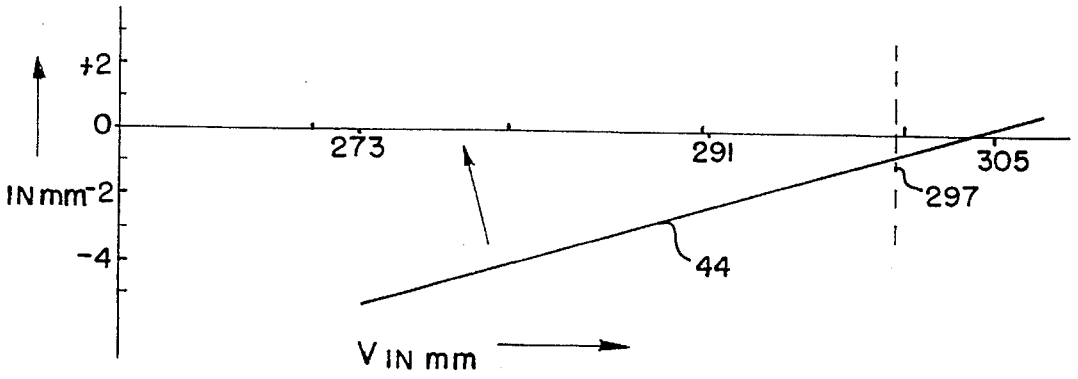
FIG. 7 is a graph showing the relationship between set folding length and position-deviation of the first fold which has to be corrected.

Besides the above-mentioned relationship between the length of sheet L and the deviation d of a set distance between the sheet edge and fold (the folding length V) is, also caused by slip, the realized folding length also dependent of the area in which the set folding length lies. When the folding length is set at a greater size, the initial period of the greatest speed difference between the folding rollers (24 m/min) and feed rollers (20 m/min) is longer, as a result of which more slip occurs, in such a way that the folding rollers pull a sheet through the slower moving feed nips, thus forming the first fold too late. In this way, a longer folding length V comes about then is set. Also the relationship between set folding length and deviation d caused is linear, as shown in FIG. 7 by line 44. A correction mechanism for this exists therein to fix the point of time of folding, which point of time is derived form the duration of driving of the feed rollers, for a sheet of determined length (for example 841 mm) and a determined folding length (for example 297 mm) in such a way that deviation d becomes and for other folding lengths to adjust the point of time of folding in such a way that for other set folding lengths the point of time of folding is put forward or backward so that the deviation at each set folding length becomes 0 and line 44 than is rotated as it were and coincides with the X-axis of FIG. 7.

The invention can also be applied to a folding device of the type described in EPB 0 156 326, in which the deflecting means are not constructed as a folding flap (7) at the transition between the feed path (3) and the folding path (18), but instead as an endless belt drivable in opposite directions, which replaces the folding rollers (14 and 17) and the baffle plate 19.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A folding device for the zigzag folding of a sheet in a folding cycle, comprising two pairs of folding rollers which each form two parallel folding nips, the folding rollers of each pair are drivable alternately in opposite directions of rotation for transporting a sheet with a speed of conveyance, said folding nips being situated at some specified distance from one another in a folding path, and feed means for feeding a sheet with a speed of conveyance for folding in the folding path between the folding nips and deflecting means for alternately deflecting a part of a sheet fed to the folding nips, the speed of conveyance of the folding rollers being greater than or equal to the speed of conveyance of the feed means, wherein control means are provided which, shortly after a sheet has been folded in a folding nip, the folding rollers are changed over from a first speed of conveyance greater than the speed of conveyance of the feed means, to a second speed of conveyance equal to the speed of conveyance of the feed means, maintaining said second speed of conveyance until subsequent change of direction of drive of the folding rollers.

2. A folding device according to claim 1, characterized in that said control means sets the folding rollers at the start of the folding cycle to a third speed of conveyance greater than the first speed of conveyance, with changeover of this set third speed of conveyance to a fourth speed of conveyance less than the third but greater than the second speed of conveyance, said changeover taking place shortly after the leading part of a sheet fed to the folding nip is deflected for a first time to a folding nip and maintain this fourth speed of conveyance until the subsequent change of direction of drive of the folding rollers.

3. A folding device according to claim 2, characterized in that the fourth speed of conveyance is equal to the first speed of conveyance.

4. A folding device according to any one of the preceding claims, characterized in that folding nips are formed by rollers directly coupled to a drive.

5. A folding device according to claim 4, characterized in that the drive of the rollers forming a folding nip comprises an endless elastic drive belt so trained around rollers coupled to the folding rollers such that said folding rollers are drivable at the same circumferential speed in opposite directions of rotation.

6. A folding device according to claim 2 or 3, characterized in that the control means comprises an adjusting means to automatically adjust time between the start of a folding cycle and a change of the direction of drive of the folding rollers in dependency on the length (L) of a supplied sheet.

7. A folding device according to claim 6, characterized in that the adjusting means also adjusts time between the start of a folding cycle and subsequent change in dependency of the set folding length (V) being the distance between the leading sheet edge and a fold to be applied.

* * * * *